US006237263B1

(12) United States Patent
Hagström et al.

(10) Patent No.: US 6,237,263 B1
(45) Date of Patent: May 29, 2001

(54) PROFILE FOR MARKING ELONGATE MATTER

(75) Inventors: Kjell Hagström, Halmstad; Hans Berg, Helsingborg, both of (SE)

(73) Assignee: Nuflex HB, Malmo (SE)

( * ) Notice: Subject to any disclaimer, the term of this patent is extended or adjusted under 35 U.S.C. 154(b) by 0 days.

(21) Appl. No.: 08/347,297

(22) PCT Filed: Jun. 1, 1993

(86) PCT No.: PCT/SE93/00479

§ 371 Date: Feb. 1, 1995

§ 102(e) Date: Feb. 1, 1995

(87) PCT Pub. No.: WO93/24941

PCT Pub. Date: Dec. 9, 1993

(30) Foreign Application Priority Data

Jun. 1, 1992 (SE) ..... 9201683

(51) Int. Cl.[7] ..... G09F 3/00
(52) U.S. Cl. ..... 40/316; 40/666
(58) Field of Search ..... 40/306, 309, 316, 40/317, 665, 666

(56) References Cited

U.S. PATENT DOCUMENTS

| | | | | |
|---|---|---|---|---|
| 1,983,607 | * | 12/1934 | Haas | 40/302 |
| 2,600,825 | * | 6/1952 | Aigner | 40/666 X |
| 3,088,237 | * | 5/1963 | Plummer | 40/316 |
| 4,389,755 | * | 6/1983 | Villa-Real | 40/658 X |
| 4,641,443 | * | 2/1987 | Wilmes | 40/316 |
| 4,887,324 | * | 12/1989 | Cairns | 24/487 X |
| 5,152,034 | * | 10/1992 | Konings | 24/487 X |
| 5,271,981 | * | 12/1993 | Oxenhandler | 40/316 X |
| 5,410,828 | * | 5/1995 | Millet et al. | 40/316 |

FOREIGN PATENT DOCUMENTS

| | | | | |
|---|---|---|---|---|
| 2648421 | | 4/1978 | (DE) . | |
| 3422511 | | 4/1987 | (DE) . | |
| 0002619 | | 6/1979 | (EP) . | |
| 0166624 | | 1/1986 | (EP) . | |
| 0186112 | | 7/1986 | (EP) . | |
| 2076462 | * | 12/1981 | (GB) | 24/487 |
| 184004 | | 5/1963 | (SE) . | |

* cited by examiner

*Primary Examiner*—Brian K. Green
(74) *Attorney, Agent, or Firm*—Evenson, McKeown, Edwards & Lenahan, P.L.L.C.

(57) ABSTRACT

An extrudable flexible material profile (1), for marking electric leads, cables, hoses and other elongate objects (12). The profile comprises a center portion (4) oriented along the longitudinal axis of the profile. Locking means (3) extend in parallel with said longitudinal axis (13) at each side of the center portion (4) which by mutual coupling-up are making it possible for the profile to form a closed hollow section. The material thickness of the profile is dimensioned for flexibility in the center portion (4) and for rigidity in the lock means (3).

7 Claims, 3 Drawing Sheets

PROFILE FOR MARKING ELONGATE MATTER

TECHNICAL FIELD

The present invention refers to an extrudable flexible material profile, for marking electrical leads, cables; hoses and other elongate objects, comprising a center portion oriented along the longitudinal axis of the profile.

BACKGROUND OF THE INVENTION

A procedure for marking of strips with the method described in the invention is known, i.e. to use an electronic thermo print head and lamination technology, which is used here in a new application. Also known devices and procedures for marking elongate material by means of electric hand tools or machines. It is even known to mark electric cables by threading differently colored and/or already marked sleeves onto cables. These sleeves are kept in boxes with different compartments beside the installer and rare clamped or threaded onto the cable. Two examples of this procedure are described in SE 7804949-1 and U.S. Pat. No. 4,641,443 which discloses various mark profiles attachable from the side.

The marking systems mentioned above are flexible but time-consuming to mount. It is also known to use already marked sleeves supporting the whole identity number, these are less time consuming to mount but are not flexible sinse they must be ordered in advance according to specification.

For a long time, there has existed a need of a marking system which is both time efficient and flexible. SE 456 199 discloses a solution to the problem which for some reasons has not been accepted on the market, which in contrast to this invention comprises sleeves which are marked by means of a pair of portable marking tongs which deform a sleeve consisting of several color layers.

THE TECHNICAL PROBLEM

The purpose of present invention is to provide a method, a device for carrying out the method as well as a marking module for using the method that combines the advantages of the known main types, without incorporating their drawbacks.

THE SOLUTION

For this object, the invention comprises in-locking means extending in parallel with said longitudinal axis at each side of the center portion which by mutual coupling-up make it possible for the profile to form a closed hollow section, and the material thickness of the profile is dimensioned for flexibility in the centre portion and for rigidity in the locking means.

BRIEF DESCRIPTION OF THE DRAWINGS

The invention will be described hereinafter with reference to an embodiment which is shown in the enclosed drawings, in which.

DESCRIPTION OF PREFERRED EMBODIMENTS

Figure 1:
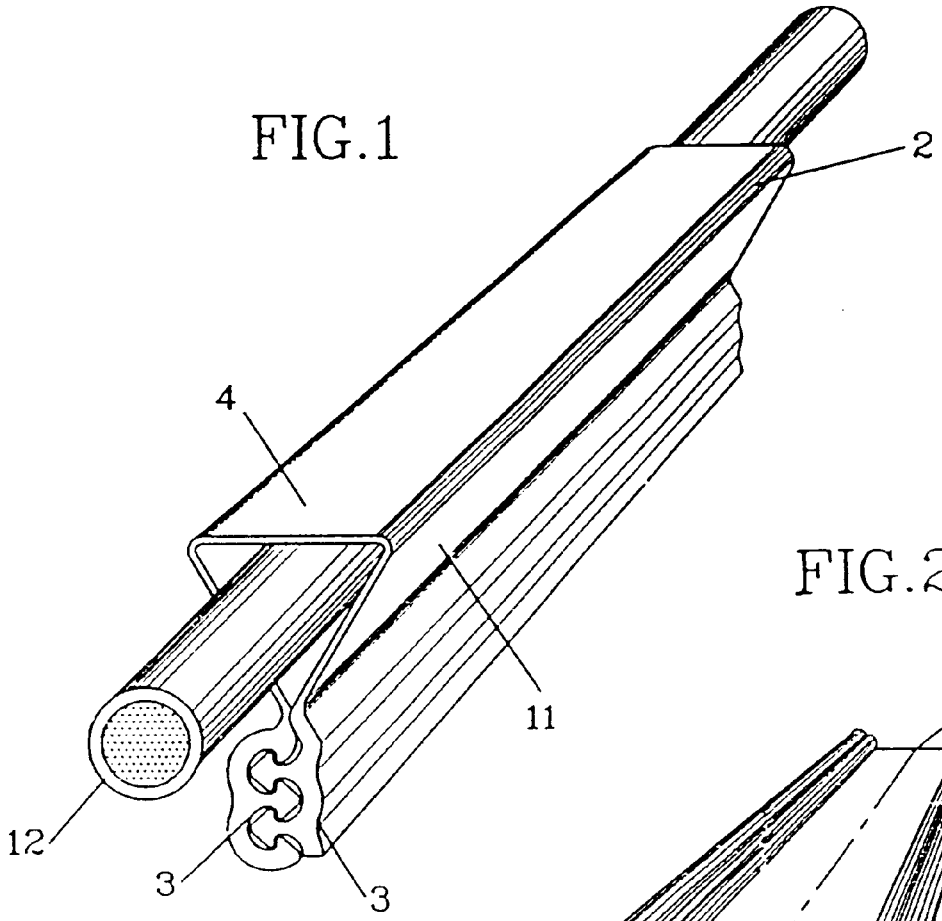
FIG. 1 shows the marking module in perspective view.
Figure 2:
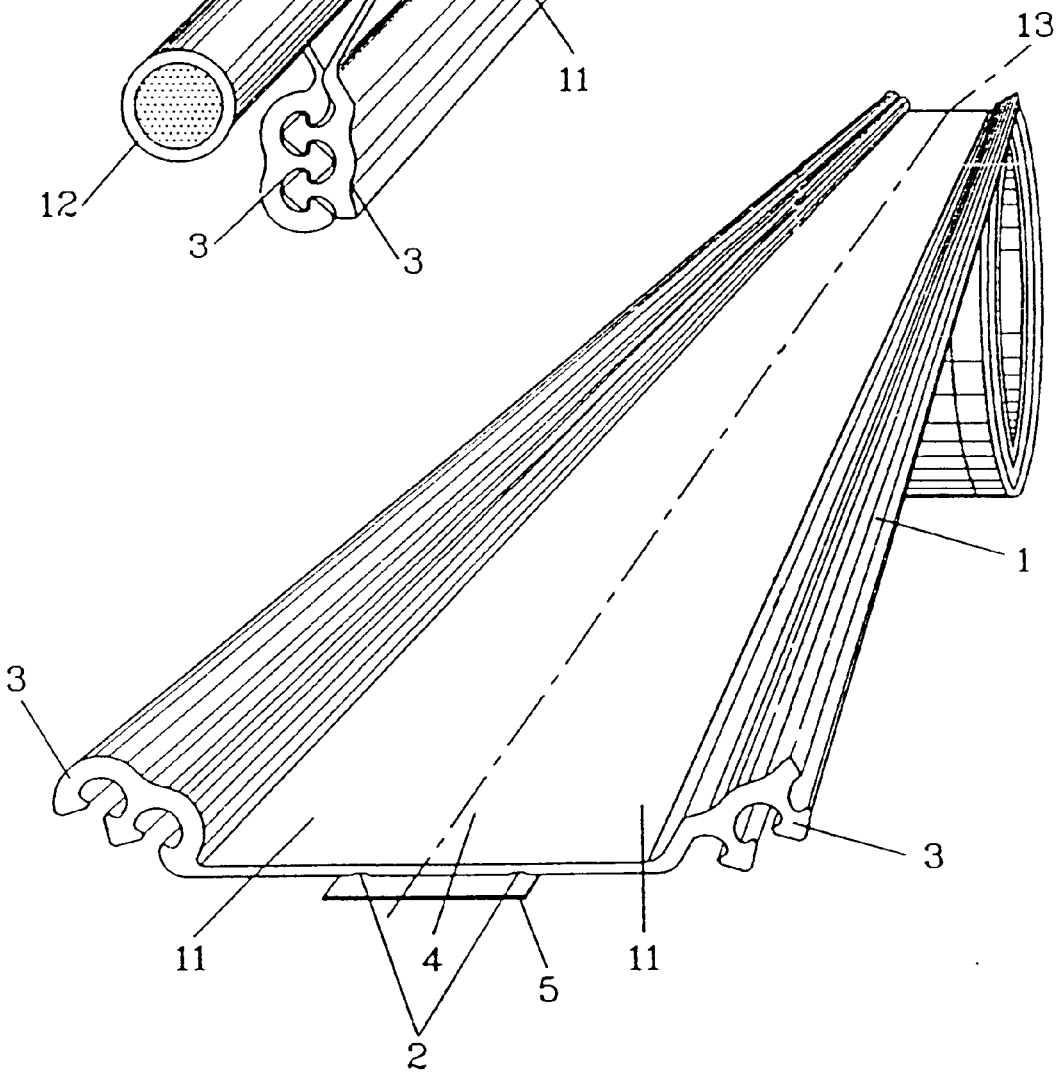
FIG. 2 shows the marking module in perspective view in a flat ribbon-shaped condition.

The marking module consists of an extrudable profile of flexible material that includes a center portion 4 oriented along the longitudinal axis 13 of the profile and locking means 3 extending in parallel with said longitudinal axis 13. The center portion 4 continues via fold notches 2 into shank portions 11 extending in parallel with said longitudinal axis 13 between the center portion 4 and a locking means 3 provided on each side of said portion. After mutual coupling-up of the lock means 3, the profile forms a closed hollow profile which surrounds the conductor 12.

The thickness of the profile material is dimensioned for flexibility in the center portion 4 and for rigidity in the locking means 3.

The profile is installed on the conductor 12 from the side, which facilitates mounting.

The method and the device for performing the method must be portable and feasible so that the marking symbols can be affixed onto the marking profile at the installation site according to the user's need and needs for flexibility.

According to FIG. 1, the marking module comprises a band shaped profile 1 which is folded at the fold notches 2 round the cable 12 into a triangular shape which encompasses the cable, and which is locked together by means of the lockings 3 formed on the shanks 11. The triangular shape is achieved partly by the fold notches 2 and partly by the somewhat angled transition of the shanks 11 over to the lockings 3.

Figure 3:
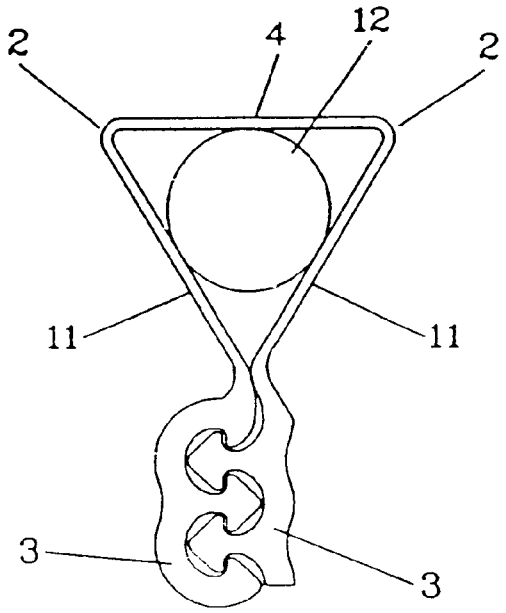
FIG. 3 shows the marking module in profile with the entire lock closed in position for the smallest cable diameter.

The locking which for example is shown in FIG. 3, is of catch type with two hermaphrodite-shaped lock halves 3, of the number of male locking means and their acute-angle is designed for achieving the best possible guidance.

Figure 4:
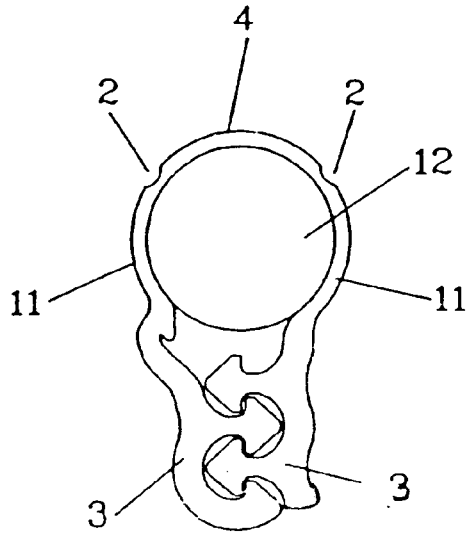
FIG. 4 shows the marking module in profile with only the outer locking means closed in position for the biggest cable diameter, FIG. 5 discloses the marking method.

The marking can be adapted to a wide range of dimensions since the locking can be made in steps. In an unbuttoned position, the innermost locking step is designed to follow the conductor's periphery line, see FIG. 4. The triangular shaped closed profile is in itself expandable, in combination with the length of the marking module, which makes it adaptable to a large number cable diameters.

The marking module is preferably manufactured in a transparent plastic material, for example SURLYN ionomer, and the marking symbols affixed to the centre section 4, i.e. the back side of the locking, onto the module's inside/cable side. A protective film 5 in contrasting color is adhesively mounted over the marking symbols near to the cable. The protective film 5 can thereby function as means for defining the fold notches.

Another embodiment is obtained by applying the marking symbols to a transparent film that is laminated onto the top or outer side of the above described marking module which is given a contrasting color.

A third embodiment is obtained by applying the marking directly on top or outer surface of the marking module with or without a protective film.

Figure 5:
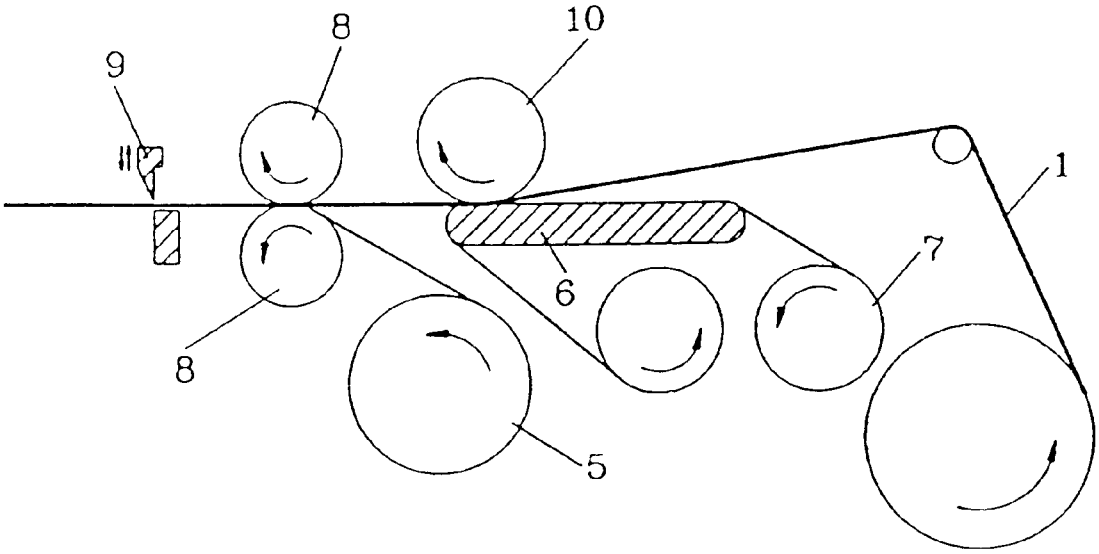

The marking symbols are applied as is shown in FIG. 5 upon the marking module by means of a method where the marking module by means of a unfolded band-shaped profile runs in contact with an electric thermo print head 6 together with a color ribbon 7 with a certain contact pressure. Subsequently the profile is laminated together with a self-adhesive film 5 by means of two compression rollers 8 one of which is driving. Then the marking module is cut into an appropriate length.

The device shown in FIG. 5 for the above described method, comprises an electric operated portable unit, mainly comprising a keyboard or similar symbol selection unit, an electronic thermo print head 6, a feed motor and feed mechanism, a compression wheel for lamination 8 and marking support roller 10, electronics for memory and guiding, a display, a separation knife 9, magazines containing the marking module band, a color ribbon and the self adhesive protective film, all enclosed in one or more protective casings. The thermo print head can for instance be replaced by an ink jet or a line printer head.

In FIGS. 1–4 the center section 4 and the shanks 11 have been shown in a large magnification. In real life, these portions have a thickness of between 0.1 and 1 mm. The material in the lock means 3 is thicker than in the portions 4 and 11.

Figure 6:
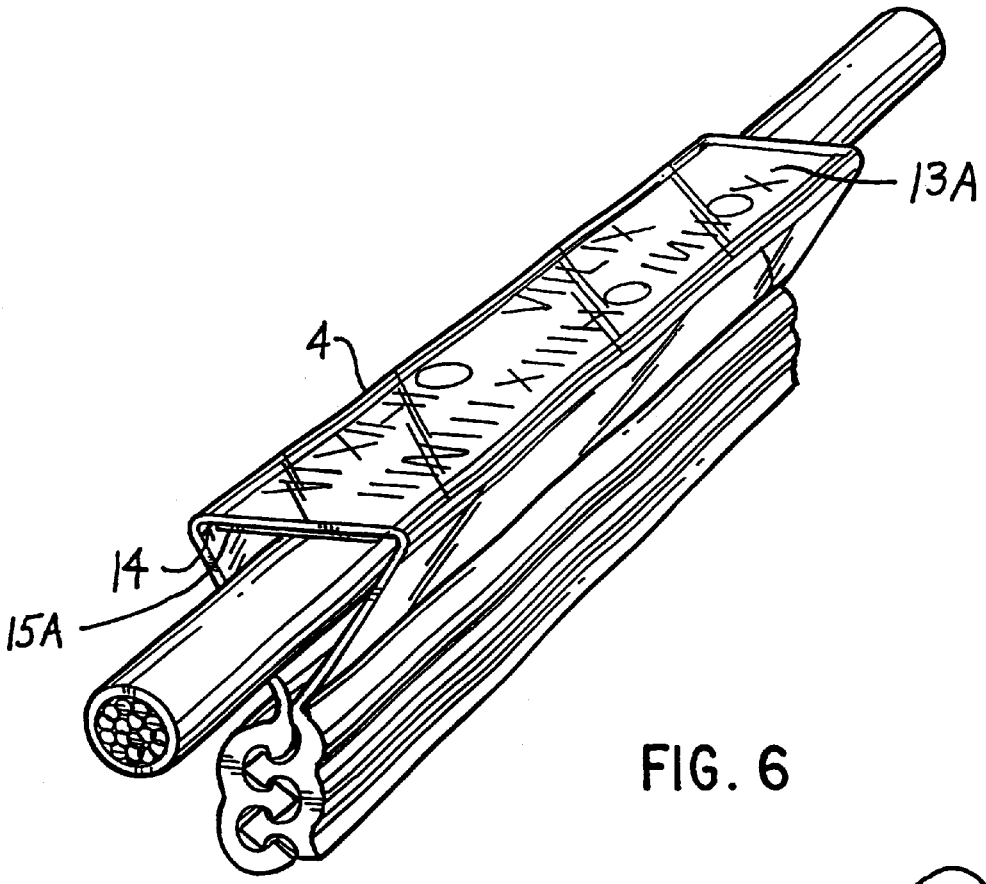
FIG. 6 shows the marking module with a transparent center portion and a protective film mounted inside the center portion.
Figure 7:
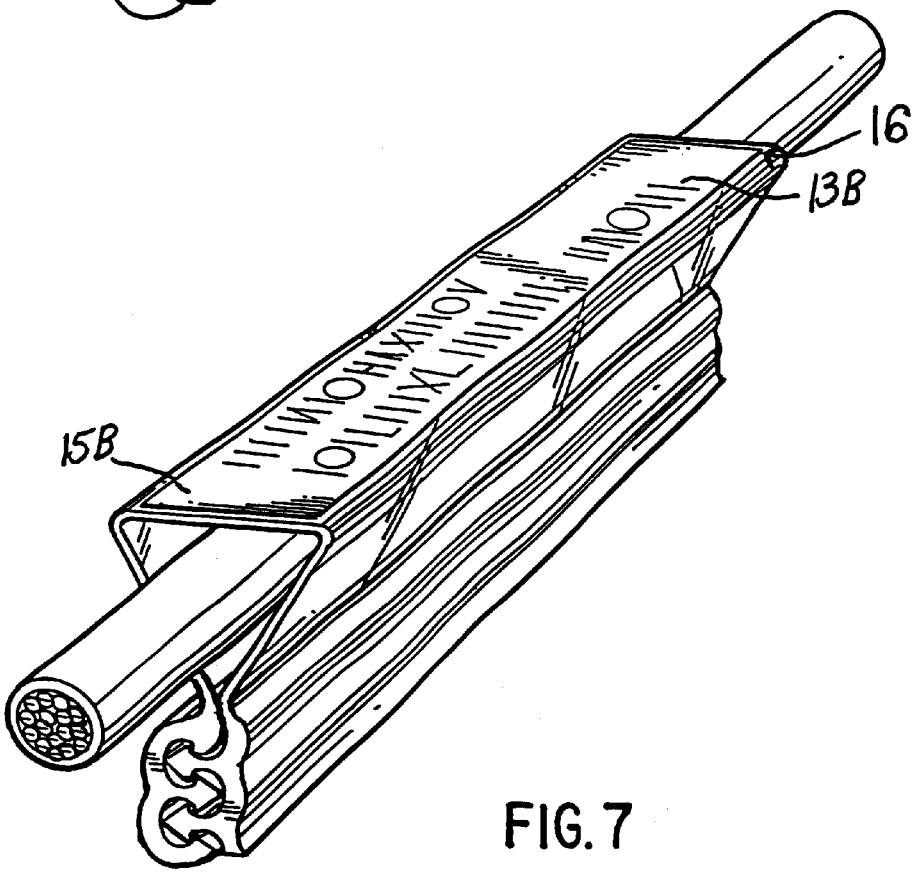
FIG. 7 shows the marking module with a transparent protective film that is laminated on an outer surface of the center portion.

As shown in FIG. 6, the center portion 4 may be transparent, with the marking symbols 13A being mounted onto the inside 14 of the center portion. A protective film 15A with a color contrasting to the marking symbols may be mounted onto the inside of the center portion. As shown in FIG. 7, the marking symbols 13B may be placed on a transparent protective film 15B that is laminated on an outer surface 16 of the center portion 4, which has a contrasting color.

The invention is not limited to the above described embodiments, but more variants are possible within the scope of the accompanying subclaims. For instance, the centre portion 4 can continue directly over to the lock means 3, without separate shank portions. Further, the marking module can comprise a layer of compressible material, for example foam plastic enabling the same marking module to be used for marking of different elongate material with different thicknesses, without risk of the marking module sliding along the elongate material. Alternatively, the centre section 4 and the shanks 11 can be provided with a layer of double adherable tape, to fix the marking module on narrow section leaders.

What is claimed is:

1. An identification module for marking electrical leads, cables, hoses and other elongate objects having a wide range of dimensions, comprising:

a band-shaped one-piece profile made of a flexible, material, said profile including opposite side portions and a center portion defined between said side portions, said opposite side portions comprising locking means which are mutually engageable with each other such that the center portion defines a closed, substantially triangular, hollow section with the locking means engaged, said center portion being provided with marking symbols, said triangular hollow section being flexible in order to allow adaptation to a cross section of the elongate object to be encompassed by the module.

2. An identification module according to claim 1, wherein the profile further comprises fold notches located between the center portion and the locking means.

3. An identification module according to claim 1, wherein the locking means are designed so that a size of a closed loop formed by the center portion and the locking means is adjustable.

4. An identification module according to claim 1, wherein at least the center portion is transparent and the marking symbols are mounted onto an inside of the center portion.

5. An identification module according to claim 4, wherein a protective film with a color contrasting to the marking symbols is mounted onto the inside of the center portion.

6. An identification module according to claim 1, wherein the marking symbols are placed on a transparent protective film that is laminated on an outer surface of the center portion which has a contrasting color.

7. An identification module for marking an elongate object, comprising:

a one-piece profile made of a flexible material, said profile including a first and a second longitudinally extending side portion and a longitudinally extending center portion being defined between said first and second side portions, wherein said first and second side portions comprise first and second locking means, respectively, said first locking means being engageable with said second locking means such that said center portion defines an enclosed triangular hollow section for peripherally surrounding the elongate object, said center portion being flexible in order to allow adaptation to a cross section of the elongate object to be encompassed by the module, said side portions having a thickness which is greater than a thickness of said center portion such that said side portions are more rigid than said center portion.

* * * * *